US008522755B2

(12) United States Patent
Boecking

(10) Patent No.: US 8,522,755 B2
(45) Date of Patent: Sep. 3, 2013

(54) PUMP, IN PARTICULAR HIGH-PRESSURE FUEL PUMP

(75) Inventor: Friedrich Boecking, Stuttgart (DE)

(73) Assignee: Robert Bosch GmbH, Stuttgart (DE)

( * ) Notice: Subject to any disclaimer, the term of this patent is extended or adjusted under 35 U.S.C. 154(b) by 603 days.

(21) Appl. No.: 12/808,942

(22) PCT Filed: Nov. 14, 2008

(86) PCT No.: PCT/EP2008/065590

§ 371 (c)(1),
(2), (4) Date: Jun. 17, 2010

(87) PCT Pub. No.: WO2009/077274

PCT Pub. Date: Jun. 25, 2009

(65) Prior Publication Data

US 2010/0269795 A1 Oct. 28, 2010

(30) Foreign Application Priority Data

Dec. 17, 2007 (DE) ..... 10 2007 060 772

(51) Int. Cl.
*F02M 37/04* (2006.01)

(52) U.S. Cl.
USPC ..... 123/495; 417/273

(58) Field of Classification Search
USPC ..... 123/495; 417/271, 273
See application file for complete search history.

(56) References Cited

U.S. PATENT DOCUMENTS

| | | | | |
|---|---|---|---|---|
| 1,964,245 | A | 6/1934 | Benedek et al. | |
| 6,350,107 | B1 | 2/2002 | Hamutcu et al. | |
| 7,278,348 | B2 * | 10/2007 | Kleinbeck et al. | 92/155 |
| 7,284,537 | B2 * | 10/2007 | Kleinbeck et al. | 123/450 |
| 7,384,246 | B2 * | 6/2008 | Diaferia et al. | 417/273 |
| 7,513,190 | B2 * | 4/2009 | Boehland et al. | 92/158 |
| 2002/0081215 | A1 | 6/2002 | Plaga | |
| 2006/0093490 | A1 | 5/2006 | Kleinbeck et al. | |

FOREIGN PATENT DOCUMENTS

| | | | |
|---|---|---|---|
| CN | 1714239 | A | 12/2005 |
| DE | 19814506 | A1 | 10/1999 |
| DE | 10058050 | C1 | 3/2002 |
| WO | 2004051084 | A1 | 6/2004 |

* cited by examiner

*Primary Examiner* — Hai Huynh
(74) *Attorney, Agent, or Firm* — Michael Best & Friedrich LLP

(57) ABSTRACT

The invention relates to a pump, particularly a high-pressure fuel pump, having a drive shaft, which includes a section that is eccentric to the rotational axis thereof and on which a ring is rotatably supported. The pump has at least one pump piston, which is directly supported on the ring via the piston base thereof, or via a support element and is driven in a stroke movement upon the rotational movement of the drive shaft. The ring has an at least approximately planar contact surface in the region of the support of the piston base or of the support element, and the support surface of the piston base or of the support element on the ring is greater than the cross-sectional surface of the shaft of the pump piston. The extension of the support surface of the piston base or of the support element in the tangential direction to the rotational axis of the drive shaft is greater than the extension thereof in the direction of the rotational axis of the drive shaft.

8 Claims, 4 Drawing Sheets

PUMP, IN PARTICULAR HIGH-PRESSURE FUEL PUMP

CROSS-REFERENCE TO RELATED APPLICATION

This application is a 35 USC 371 application of PCT/EP2008/065590 filed on Nov. 14, 2008.

BACKGROUND OF THE INVENTION

1. Field of the Invention

The invention is based on a pump, in particular a high-pressure fuel pump.

2. Description of the Prior Art

One such pump in the form of a high-pressure fuel pump is known from German Patent Disclosure DE 198 14 506 A1. This pump has a drive shaft with a portion, embodied eccentrically to its axis of rotation, on which a ring is rotatably supported. The pump has at least one pump piston, which is braced on the ring directly via its piston base or via a support element and which upon a rotation of the drive shaft is driven in a reciprocating motion. In the vicinity of the contact of the piston base or of the support element, the ring has an at least approximately plane contact face. The bracing face of the piston base or of the support element on the ring is larger than the cross-sectional area of the shaft of the pump piston. The bracing face of the piston base or of the support element is typically embodied circularly, and to avoid tilting motions of the ring relative to the piston base or support element, it should be as large as possible. Particularly at the transition from the delivery reciprocating motion, oriented outward away from the drive shaft, to the intake reciprocating motion, directed inward toward the drive shaft, of the pump piston, tilting of the ring can occur. Because of this tilting, at high rpm of the drive shaft, damage can occur to the ring and/or the pump piston or the support element. However, since the pump should have as compact a structure as possible, it is difficult to accommodate a piston base or support element with a large bracing face, particularly in the direction of the axis of rotation of the drive shaft.

ADVANTAGES AND SUMMARY OF THE INVENTION

The pump according to the invention has the advantage that as a result of the great extent of the bracing face in the tangential direction to the axis of rotation of the drive shaft, tilting of the ring is avoided, and because of the lesser extent of the bracing face in the direction of the axis of rotation of the drive shaft, a compact structure of the pump is made possible.

According to various features of the invention, tilting of the ring is hindered even more effectively, and the guidance of the piston base for the support element is improved.

BRIEF DESCRIPTION OF THE DRAWINGS

A plurality of exemplary embodiments of the invention are shown in the drawings and described in further detail in the ensuing description, in conjunction with the drawings, in which.

DESCRIPTION OF THE PREFERRED EMBODIMENTS

Figure 1:
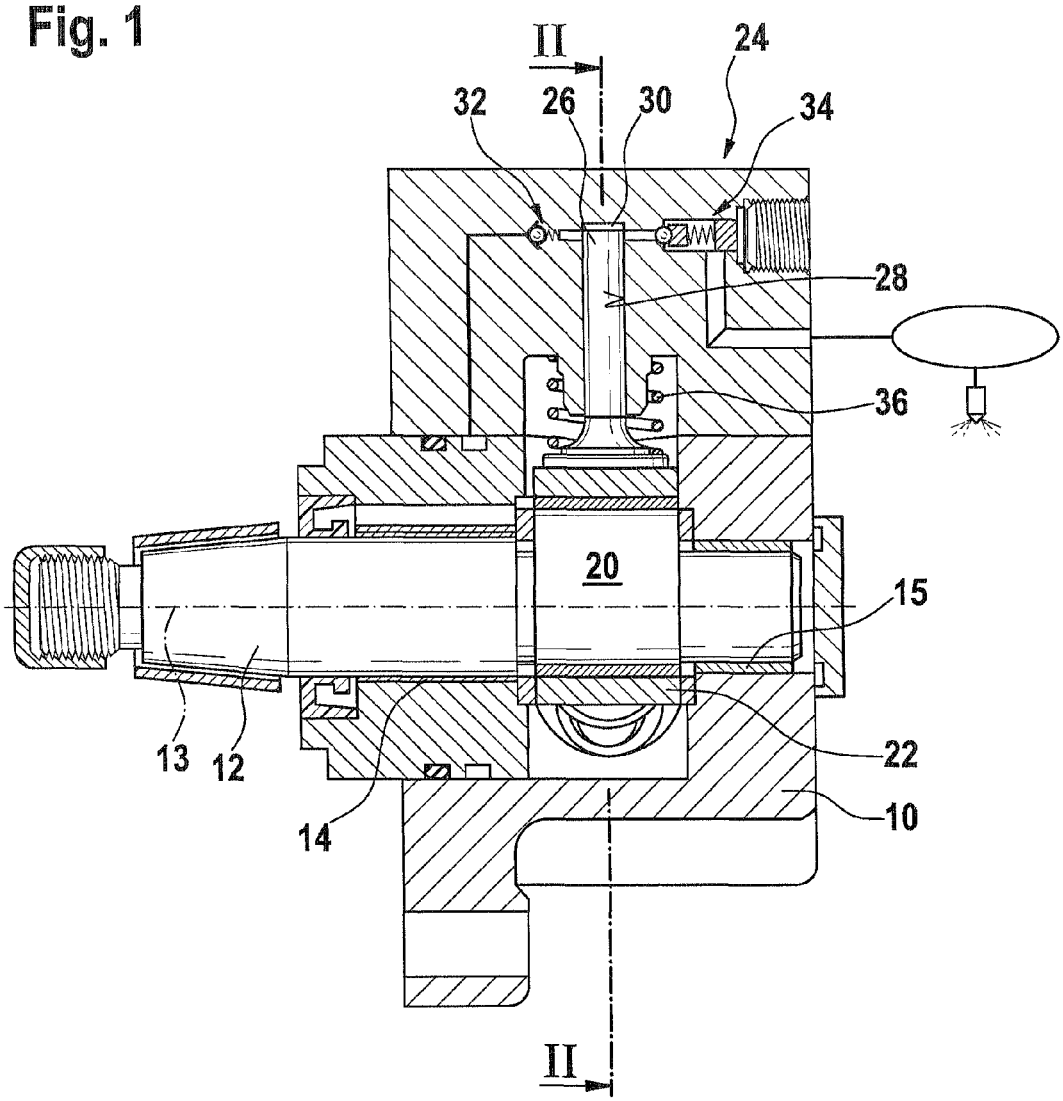
FIG. 1 shows a pump in a longitudinal section.

In FIGS. 1 through 6, a pump is shown, which in particular is a high-pressure fuel pump for a fuel injection system of an internal combustion engine. The pump has a housing 10, which may be embodied in multiple parts, and in which a rotationally driven drive shaft 12 is disposed. The drive shaft 12 is supported rotatably in the housing 10 via two bearing points 14 and 15, spaced apart from one another in the direction of the axis of rotation 13 of the drive shaft 12. The bearing points 14, 15 may be disposed in various parts of the housing 10. The direction of rotation of the drive shaft 12 is indicated by an arrow 17.

In a region located between the two bearing points 14, 15, the drive shaft 12 has a portion 20 which is embodied eccentrically to its axis of rotation 13 and which has a cylindrical shape, and on which a ring 22 is rotatably supported. In the pump, one or more pump elements 24 are provided, each of which has a pump piston 26 that is driven in a reciprocating motion at least indirectly by the portion 20 of the drive shaft 12 and by the ring 22 supported on it.

If the pump has two pump elements 24, then they are disposed diametrically opposite one another, for example, as shown in FIG. 1, or in other words rotated 180° about the axis of rotation 13 of the drive shaft 12 relative to one another. If the pump has three pump elements 24, then they are for instance disposed each rotated 120° from one another about the axis of rotation 13 of the drive shaft 12.

Each pump piston 26 is guided displaceably and tightly in a respective cylinder bore 28 of a housing part of the pump and with its face end remote from the drive shaft 12, each pump piston defines a pump work chamber 30. In the inward-oriented intake stroke of the pump piston 26, toward the drive shaft 12, the pump piston aspirates fuel from an inlet into the pump work chamber 30, via an inlet valve 32. In the delivery stroke, oriented outward, away from the drive shaft 12, the pump piston 26 comprises the fuel in the pump work chamber 30 and positively displaces fuel via an outlet valve 34 into an outlet, which leads for instance to a high-pressure reservoir. The return motion of the pump piston 26 in its intake stroke is effected by means of a restoring spring 36. For each pump piston 26, the ring 22 has an at least approximately plane contact face 40, on which the pump piston 26 is braced directly with its piston base 42 or via a respective support element 54 or 64 .

Figure 2:
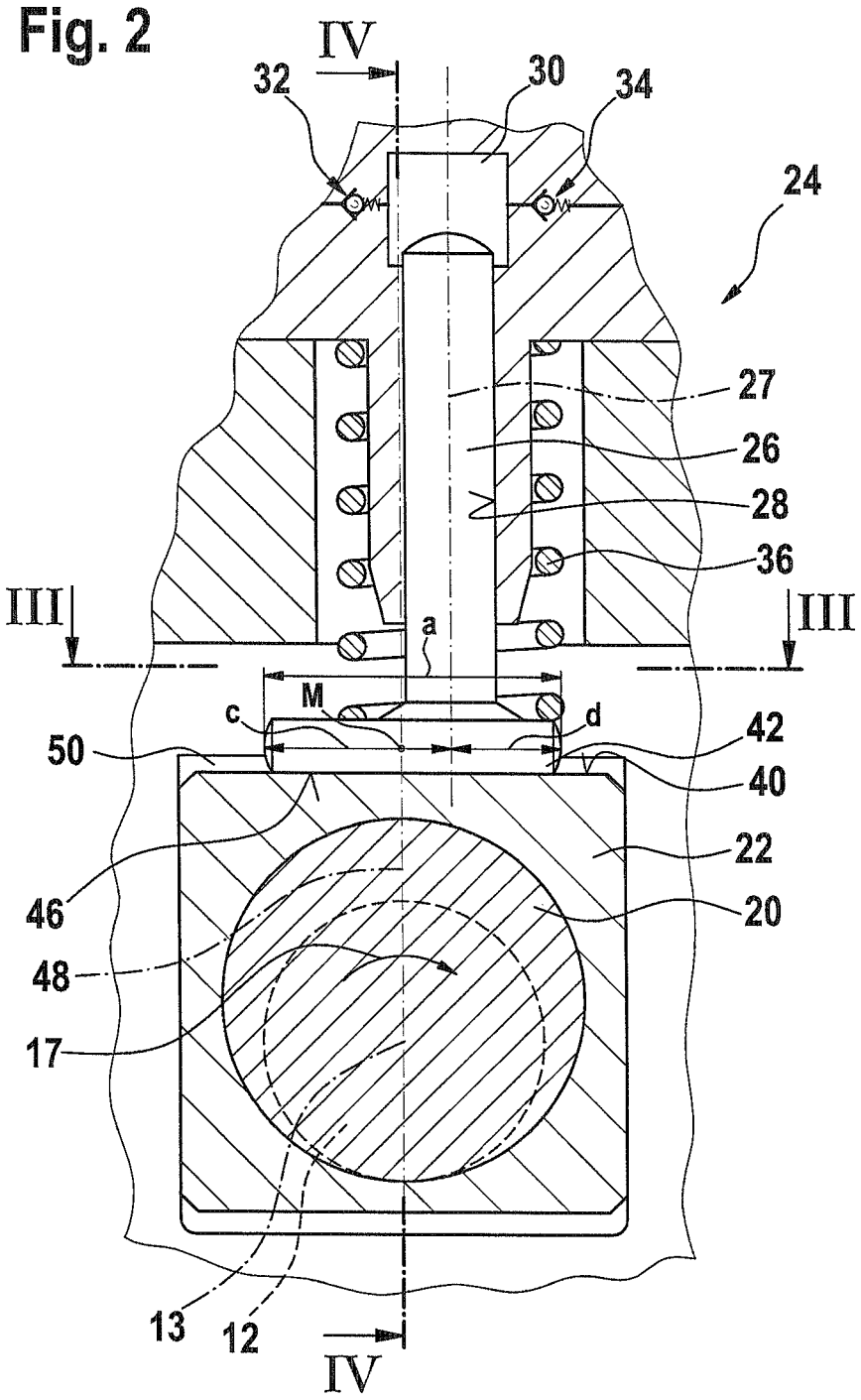
FIG. 2 shows an enlarged detail of the pump in a cross section along the line II-II in FIG. 1, in a first exemplary embodiment.
Figure 3:
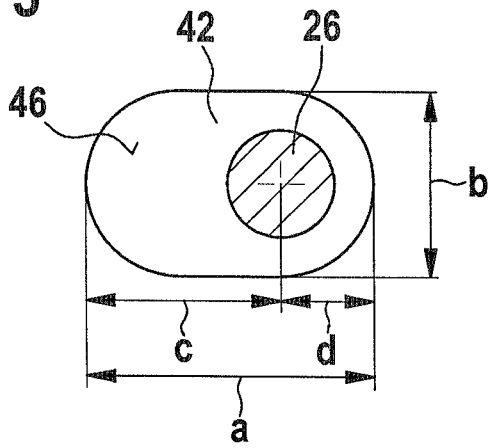
FIG. 3 shows the pump in a section taken along the line III-III in FIG. 2.

In FIG. 2, the pump is shown in a first exemplary embodiment, in which the pump piston 26 is braced directly with its piston base 42 on the contact face 40 of the ring 22. The bracing face 46 of the piston base 42 is larger than the cross-sectional area of the shaft of the pump piston 26 that is disposed in the cylinder bore 28. The restoring spring 36 is fastened between the piston base 42 and a housing part of the pump. The bracing face 46 is embodied as at least approximately plane and, as shown in FIG. 3, it is has a greater extent in the tangential direction relative to the axis of rotation 13 of the drive shaft 12 than in the direction of the axis of rotation 13. The extent of the bracing face 46 in the tangential direction is marked a, and its extent in the direction of the axis of rotation 13 is marked b. Moreover, as shown in FIGS. 2 and 3, in the tangential direction relative to the axis of rotation 13 of the drive shaft 12, beginning at the longitudinal axis 27 of the pump piston 26, the bracing face 46 has a greater extent counter to the direction of rotation 17 of the drive shaft 12 than in the direction of rotation 17 of the drive shaft 12. The extent of the bracing face 46 counter to the direction of rotation 17 is marked c and its extent in the direction of rotation 17 is marked d.

The pump piston 26 is disposed such that its longitudinal axis 27 does not intersect the axis of rotation 13 of the drive shaft 12, but instead is offset relative to the axis of rotation 13 in the direction of rotation 17 of the drive shaft 12. Thus in the region of the bracing face 46, the longitudinal axis 27 of the pump piston 26 is offset in the direction of rotation 17 by an amount f relative to a radial plane 48 that contains the axis of rotation 13 of the drive shaft 12.

The bracing face 46 is preferably embodied such that in the tangential direction relative to the axis of rotation 13 of the drive shaft 12, its center M is located at least approximately in the radial plane 48, as is shown in FIGS. 2 and 3. With regard to the longitudinal axis 27 of the pump piston 26, the bracing face 46 is thus embodied asymmetrically, since it has the greater extent c counter to the direction of rotation 17 and the lesser extent d in the direction of rotation 17. Relative to the radial plane 48, however, the bracing face 46 is embodied symmetrically, with its center M in the radial plane 48.

Figure 4:
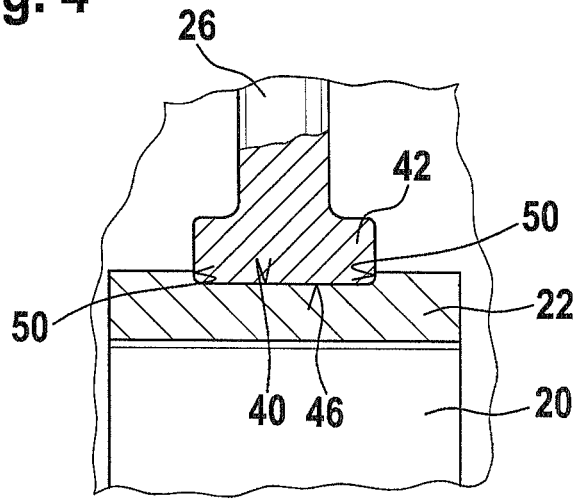
FIG. 4 shows a detail of the pump in a section taken along the line IV-IV in FIG. 2.

It may be provided that, as shown in FIG. 4, in the direction of the axis of rotation 13 of the drive shaft 12, guide faces 50 protruding relative to the contact face 40 are disposed on the ring 22 next to the contact face 40. The guide faces 50 are embodied as at least approximately plane, and between them, the piston base 42 is disposed with little play. Thus the guide faces 50 form a guide for the piston base 42, by which guide the piston base 42 is prevented from being able to move in the direction of the axis of rotation 13 of the drive shaft 12 relative to the ring 22.

The bracing face 46, for instance as shown in FIG. 3, is embodied as rounded on its edges that point in the tangential direction to the axis of rotation 13 of the drive shaft 12, and as at least approximately plane on its edges that point in the direction of the axis of rotation 13.

Figure 5:
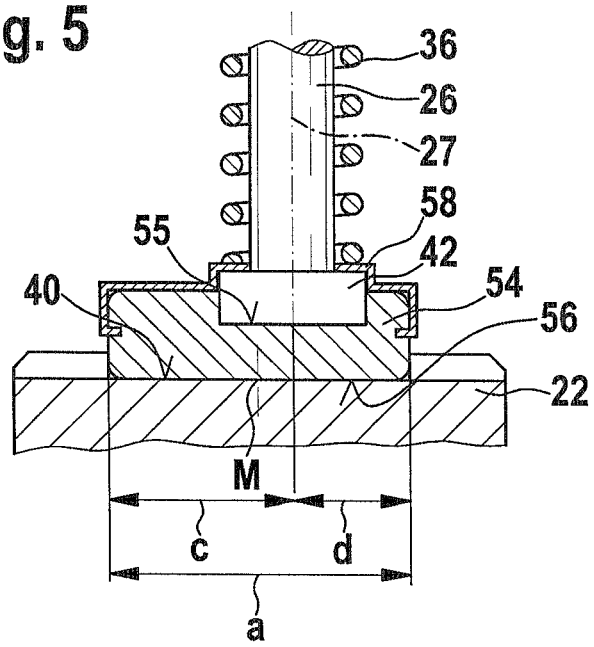
FIG. 5 shows the pump in a second exemplary embodiment.

In FIG. 5, the pump is a second exemplary embodiment is shown in a detail; the basic construction is the same as in the first exemplary embodiment, but the pump piston 26 is braced on the contact face 40 of the ring 22 via a platelike support element 54. The support element 54 is connected to the piston base 42 of the pump piston 26, which base does have a larger cross-sectional area compared to the shaft of the pump piston 26 but a smaller cross-sectional area than in the first exemplary embodiment. The support element 54, on its side remote from the ring 22, has an indentation 55 into which the piston base 42 is inserted. The connection between the piston base 42 and the support element 54 may be embodied rigidly or in articulated fashion. For instance, the connection of the piston base 42 to the support element 54 may be made by means of a clamplike securing element 58 that fits over both the piston base 42 and the support element 54. The bracing face 56 of the support element 54, with which face the support element comes to rest on the ring 22 at the contact face 40, is embodied identically to the bracing face 46 of the piston base 42 in the first exemplary embodiment.

Figure 6:
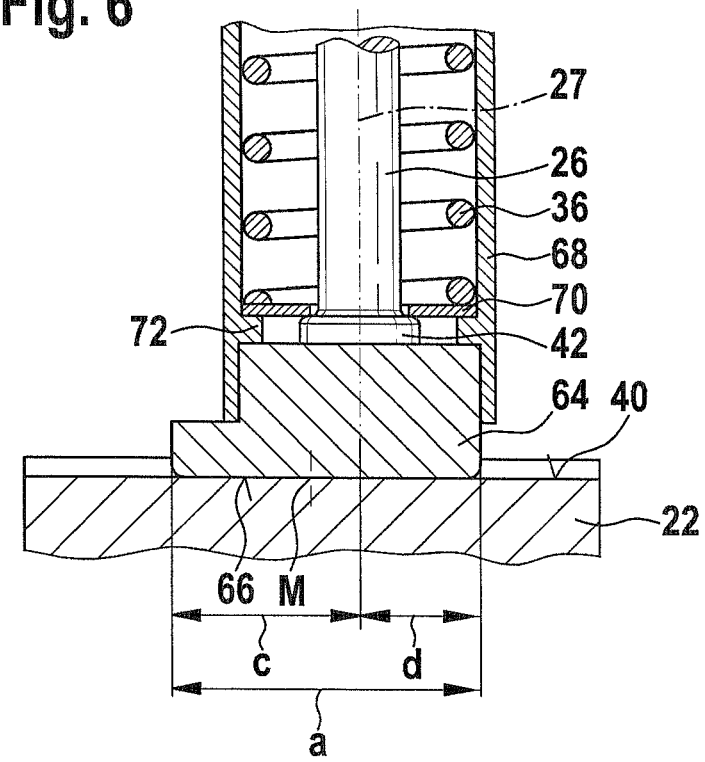
FIG. 6 shows the pump in a third exemplary embodiment.

In FIG. 6, a detail of the pump in a third exemplary embodiment is shown, in which the basic construction is again the same as in the first exemplary embodiment, but the pump piston 26 is braced on the contact face 40 of the ring 22 via a support element 64. The support element 64 is disposed as an insert in a tappet 68, which is embodied essentially hollow-cylindrically. The tappet 68 is guided displaceably over its outer circumference in a bore of a housing part of the pump, or via its inner circumference on a cylindrical attachment of a housing part of the pump. The pump piston 26 protrudes into the tappet 68 and rests with its piston base 42 on the side of the support element 64 remote from the ring 22. The restoring spring 36 is braced on a spring plate 70, which is in turn braced on both the piston base 42 and a protrusion 72 protruding radially inward on the tappet 68 and thus urges both the tappet 68 and the pump piston 26, and by way of them the support element 64, toward the ring 22. The support element 64 has a bracing face 66, oriented toward the ring 22 and resting on the contact face 40 of the ring, and this bracing face is embodied identically to the bracing face 46 of the piston base 42 of the first exemplary embodiment.

The foregoing relates to the preferred exemplary embodiment of the invention, it being understood that other variants and embodiments thereof are possible within the spirit and scope of the invention, the latter being defined by the appended claims.

The invention claimed is:

1. A pump, in particular a high-pressure fuel pump, having
a rotationally driven drive shaft that has a portion eccentric to its axis of rotation,
a ring rotatably supported on the eccentric portion,
at least one pump piston, which is braced directly via a piston base of the piston pump or via a support element on the ring and is driven in a reciprocating motion upon the rotary motion of the drive shaft, and
in the vicinity of where the piston base or the support element is braced, ring having an at least approximately plane contact face, and a bracing face of the piston base or of the support element on the ring is larger than a cross-sectional area of a shaft of the pump piston,
wherein an extent of the bracing face of the piston base or of the support element in a tangential direction to the axis of rotation of the drive shaft is greater than its extent in a direction of the axis of rotation of the drive shaft, and
wherein the extent of the bracing face of the piston base or of the support element in the tangential direction relative to the axis of rotation of the drive shaft, beginning at a longitudinal axis of the pump piston is greater counter to the direction of rotation of the drive shaft than the extent in the direction of rotation of the drive shaft.

2. The pump as defined by claim 1, wherein the at least one pump piston is disposed such that its longitudinal axis is offset in the direction of rotation of the drive shaft, relative to the axis of rotation of the drive shaft.

3. The pump as defined by claim 2, wherein in the tangential direction to the axis of rotation of the drive shaft, the center of the bracing face of the piston base or of the support element is disposed at least approximately in a radial plane that contains the axis of rotation of the drive shaft.

4. The pump as defined by claim 3, wherein the ring, in the direction of the axis of rotation of the drive shaft, next to the contact face, has guide faces which protrude relative to the contact face and between which the piston base or the support element is guided essentially nondisplaceably in the direction of the axis of rotation of the drive shaft.

5. The pump as defined by claim 2, wherein the ring, in the direction of the axis of rotation of the drive shaft, next to the contact face, has guide faces which protrude relative to the contact face and between which the piston base or the support element is guided essentially nondisplaceably in the direction of the axis of rotation of the drive shaft.

6. The pump as defined by claim 1, wherein in the tangential direction to the axis of rotation of the drive shaft, the center of the bracing face of the piston base or of the support element is disposed at least approximately in a radial plane that contains the axis of rotation of the drive shaft.

7. The pump as defined by claim 6, wherein the ring, in the direction of the axis of rotation of the drive shaft, next to the contact face, has guide faces which protrude relative to the contact face and between which the piston base or the support element is guided essentially nondisplaceably in the direction of the axis of rotation of the drive shaft.

8. The pump as defined by claim 1, wherein the ring, in the direction of the axis of rotation of the drive shaft, next to the contact face, has guide faces which protrude relative to the contact face and between which the piston base or the support element is guided essentially nondisplaceably in the direction of the axis of rotation of the drive shaft.

* * * * *